United States Patent [19]

Lindblad

[11] 4,113,033

[45] Sep. 12, 1978

[54] METHOD AND ARRANGEMENT FOR POSITIONING A WORKING TOOL TO A PREDETERMINED DIRECTION AND/OR A PREDETERMINED POINT

[75] Inventor: Lars Alfred Lindblad, Saltsjo-Boo, Sweden

[73] Assignee: Atlas Copco Aktiebolag, Nacka, Sweden

[21] Appl. No.: 830,213

[22] Filed: Sep. 2, 1977

Related U.S. Application Data

[63] Continuation of Ser. No. 639,693, Dec. 11, 1975, abandoned.

[30] Foreign Application Priority Data

Dec. 19, 1974 [SE] Sweden ..... 7415975

[51] Int. Cl.[2] ..... E21C 11/02

[52] U.S. Cl. ..... 173/1; 173/4; 173/21

[58] Field of Search ..... 173/2, 4, 43, 20, 21; 182/2; 408/3, 13; 318/564, 565

[56] References Cited

U.S. PATENT DOCUMENTS

| | | | |
|---|---|---|---|
| 1,755,975 | 4/1930 | Willard | 318/655 X |
| 2,596,130 | 5/1957 | Cunningham | 318/655 |
| 3,253,484 | 5/1966 | Hill | 408/13 |
| 3,307,637 | 3/1967 | Jonsson | 408/13 X |
| 3,481,409 | 12/1969 | Westerlund | 173/43 |
| 3,492,467 | 1/1970 | Caban et al. | 403/3 X |
| 3,891,039 | 6/1975 | Lagerstrom | 173/21 X |
| 3,896,885 | 7/1975 | Dahlstrom et al. | 173/2 |

*Primary Examiner*—Ernest R. Purser
*Assistant Examiner*—William F. Pate, III
*Attorney, Agent, or Firm*—Flynn & Frishauf

[57] ABSTRACT

A working implement such as a rock drilling apparatus is automatically positioned to predetermined positions and/or directions. Particularly, a drill bit is moved to an imaginary plane spaced from the surface to be worked upon completion of a drill hole by programming the predetermined positions such that they are in said imaginary plane. The actual values of the position and/or direction of the working implement may be adjusted simultaneously toward set values corresponding to the predetermined position and/or direction.

20 Claims, 5 Drawing Figures

METHOD AND ARRANGEMENT FOR POSITIONING A WORKING TOOL TO A PREDETERMINED DIRECTION AND/OR A PREDETERMINED POINT

This is a continuation of application Ser. No. 639,693, filed Dec. 11, 1975.

BACKGROUND OF THE INVENTION

This invention relates to a method and arrangement for automatically positioning a working implement, such as a drill bit, to predetermined positions and/or predetermined directions in space, wherein said predetermined positions and directions are defined by given values of respectively coordinates and an angle or angles in a system of coordinates.

The invention may to advantage be used for rock drilling, which means that the working implement is a drill bit. The invention, however, is applicable generally to positioning of different types of working implements, for instance for controlling of industrial robots.

When applying the invention to rock drilling it is, due to the irregularities of the rock surface intended to be worked, necessary to undertake measures in order to safeguard that the drill bit does not get stuck during movement from one predetermined position to another. According to one aspect of the invention the predetermined positions are programmed such that they are in an imaginary plane which is spaced from the rock surface.

A further object of the invention is to provide an automatic movement of the working implement to programmed positions according to a pattern, such as a drilling pattern, such that the working implement is moved to a predetermined position and/or is adjusted to a predetermined direction in shorter time than is obtainable in hitherto known constructions for automatic movement of a working implement.

To this end, the actual values of the coordinates and/or the angle or angles are sensed continuously. According to another aspect of the invention, the sensed actual values are adjusted simultaneously toward the values programmed in advance. In doing so, a considerable saving of time is achieved when comparing with constructions where the different means for moving the working implement are actuated in turn.

BRIEF DESCRIPTION OF THE DRAWINGS

The above and other purposes of the invention will become obvious from the following description with reference to the accompanying drawings, in which one embodiment is shown by way of example. It is to be understood that this embodiment is only illustrative of the invention and that various modifications thereof may be made within the scope of the claims following hereinafter.

DETAILED DESCRIPTION OF THE PREFERRED EMBODIMENT

Figure 1:
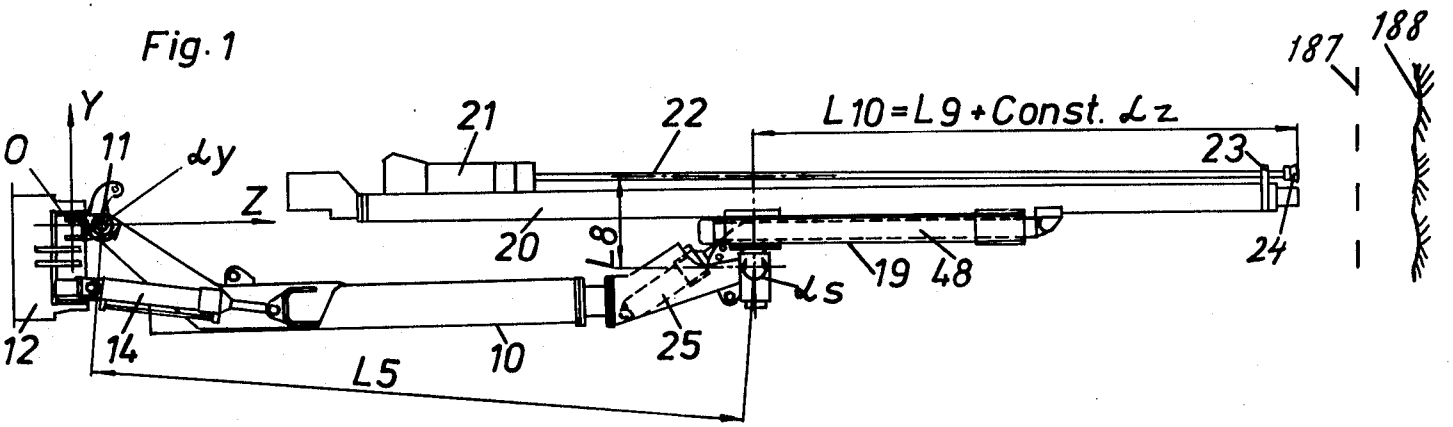
FIG. 1 is a side view of a drill boom and a feed bar having a rock drilling machine movable to and fro therealong, in which the invention is applied.
Figure 2:
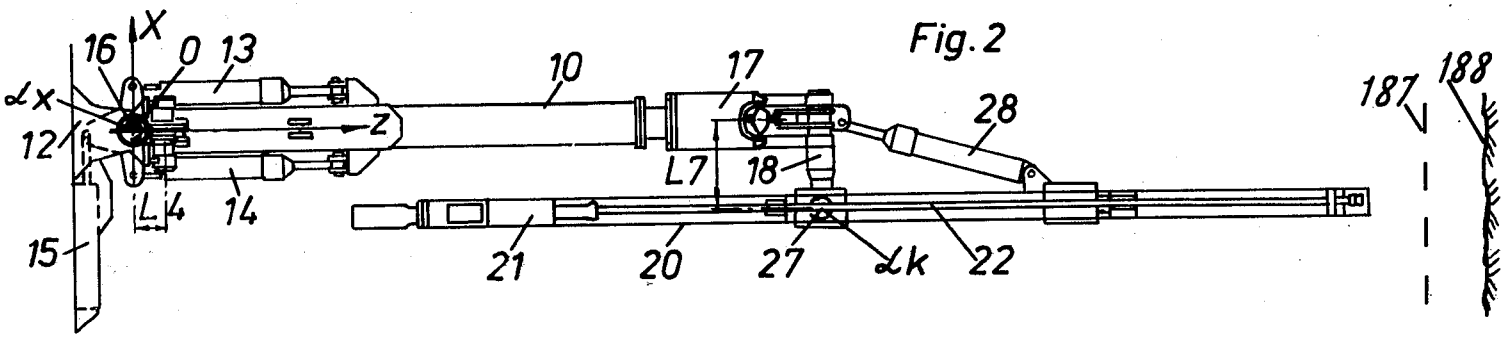
FIG. 2 is a top view of the drill boom according to FIG. 1.

In FIGS. 1, 2, a drill boom 10 is carried pivotally on a cross shaft 11 which is supported by a boom bracket 12. The pivotal angle $\alpha_y$ of the drill boom 10 about the cross shaft 11 is adjusted by means of hydraulic elevating cylinders 13, 14, which are coupled pivotally between the boom bracket 12 and the drill boom 10. The drill boom 10 can be swung about a shaft 16 which is perpendicular to the cross shaft 11 by means of a hydraulic swing cylinder 15. The swing angle about the shaft 16 is depicted $\alpha_x$.

The drill boom 10 carries a boom head 17 at its distal end. A cross shaft 18 is journalled in the boom head 17. The cross shaft 18 carries a feed holder 19. A feed bar 20 is carried longitudinally slidably on the feed holder 19 by means of guides fixed thereon. The feed bar 20 carries in conventional manner a rock drilling machine 21 mechanically fed to and fro therealong. The rock drilling machine 21 rotates a drill steel 22 and delivers impacts thereagainst. The drill steel is guided by means of a drill steel centralizer 23 on the feed bar. The drill steel 22 carries a drill bit 24. A feed displacing hydraulic cylinder 48 is attached on the one hand to the feed holder 19, and on the other to the feed bar 20. The feed bar 20 is adjusted longitudinally relative to the drill boom 10 by extension or contraction of the hydraulic cylinder 48.

A hydraulic tilt cylinder 25 is coupled pivotally between the boom head 17 and the feed holder 19. By means of the hydraulic cylinder 28 the feed holder 19 can be swung about a shaft 27 which is perpendicular to the cross shaft 18. The swing angle relative to the drill boom 10 about the shaft 27 is depicted $\alpha_k$.

In order to define the position and direction of the drill bit 24 in an arbitrary point in space it is necessary to know the coordinates and angles of the drill bit 24 in a system of coordinates in space. In FIGS. 1, 2, a system of coordinates is marked having its origin in the intersection point of the geometric axis of the shaft 16 and a plane which is perpendicular to said geometric axis and which traverses the geometric axis of the cross shaft 11. The Y-axis coincides with the geometric axis of the shaft 16, the X-axis is parallel with the cross shaft 11 and the Z-axis is perpendicular to the X- and Y-axes and extends in the longitudinal direction of the drill boom 10. The distances along the X-axis and the Y-axis, respectively, from a reference point on the shaft 16 at the level of the cross shaft 11 to an imaginary line, which runs in the desired tunnel direction and intersects an imaginary plane 187 containing the predetermined positions, are depicted respectively $X_o$ and $Y_o$. $Z_o$ depicts the distance between the abovementioned reference point and plane. The distance between the geometric axes of the cross shaft 11 and the cross shaft 18 is depicted L5. L8 depicts the distance between the geometric axis of the cross shaft 18 and the centre line of the drill steel 22. The distance between the geometric axis of the cross shaft 18 and the drill bit 24 is depicted L10. In FIG. 2, the distance between the geometric axes of the shaft 16 and the cross shaft 11 is depicted L4. In the same figure, L7 depicts the distance between the centre line of the drill boom 10, which line intersects the origin O, and the centre line of the drill steel 22.

By the abovementioned definitions, the coordinates of the drill bit 24 are as follows:

$$X - X_o = L4 \sin(\alpha_x + \alpha_o) + L5 \cos \alpha_y \sin(\alpha_x + \alpha_o) + L7 \cos(\alpha_x + \alpha_o) + L8 \sin(\alpha_y + \alpha_s) \sin(\alpha_x + \alpha_o) - L10 [\cos \alpha_k \cos(\alpha_y + \alpha_s) \sin(\alpha_x + \alpha_o) - \sin \alpha_k \cos(\alpha_x + \alpha_o)]$$

$$Y - Y_o = L5 \sin \alpha_y + L8 \cos(\alpha_y + \alpha_s) + L10 \cos \alpha_k \sin(\alpha_y + \alpha_s)$$

$$Z - Z_o = L4 \cos(\alpha_x + \alpha_o) + L5 \cos \alpha_y \cos(\alpha_x + \alpha_o) - L7 \sin(\alpha_x + \alpha_o) - L8 \sin(\alpha_y + \alpha_s) \cos(\alpha_x + \alpha_o) + L10 [\cos \alpha_k \cos(\alpha_y + \alpha_s) \cos(\alpha_x + \alpha_o) + \sin \alpha_k \sin(\alpha_x + \alpha_o)]$$

In the above terms, $\alpha_o$ depicts an angle in the XZ-plane for the drill boom 10 with respect to a given reference angle.

The direction of the drill steel 22 and thus also the direction of the drill bit 24 are defined as follows:

$$K = \alpha_o + \alpha_x + \alpha_k$$

$$S = \alpha_y + \alpha_s$$

The angle S depicts the direction of the drill steel 22 in a plane which traverses the centre line of the drill steel 22 and which is perpendicular to the shaft 18. K depicts the direction of the drill steel 22 in a plane which also traverses the centre line of the drill steel 22 and is perpendicular to said firstmentioned plane.

The angles $\alpha_x$, $\alpha_y$, $\alpha_k$ and $\alpha_s$, respectively, are measured by connecting an angle sensing means, preferably a synchro, to respective swing shaft. The distance L10 is divided into two components, a fixed one L9 which depicts the distance when the feed displacing hydraulic cylinder 48 is entirely contracted, and a variable one, constant $.\alpha_z$, which depicts the extension of the hydraulic cylinder 48. For measuring the component constant $.\alpha_z$, a rack member is mounted on the feed bar 20. The rack member cooperates with a gear wheel, which is mounted on the feed holder 19. The turning of said gear wheel is transferred to a synchro, whereby also the distance L10 is represented as an angle.

Figure 3:
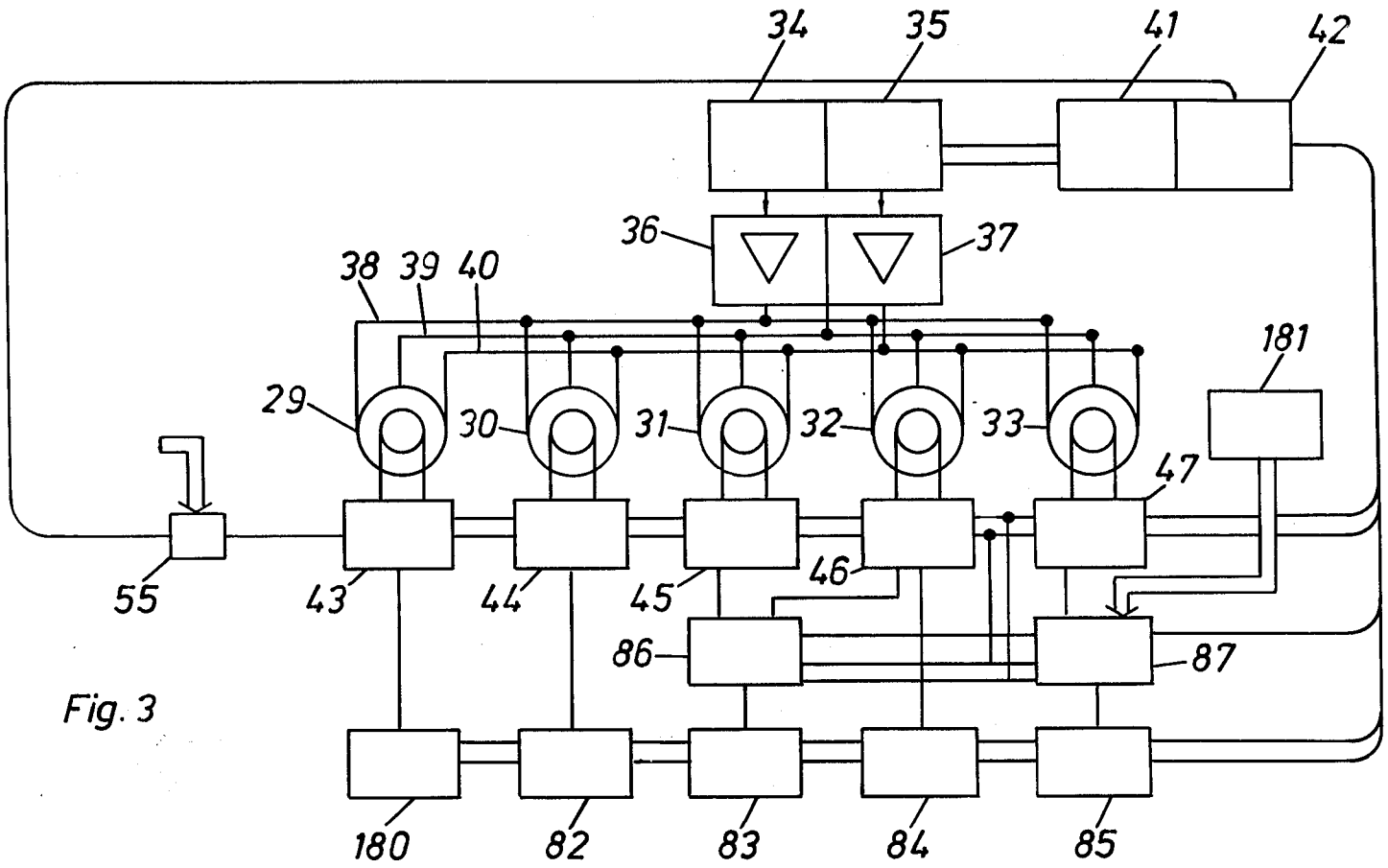
FIGS. 3, 4 and 5 show in block diagram form the control means for the hydraulic cylinders which determine the position of the drill boom and feed bar shown in FIGS. 1 and 2.
Figure 4:
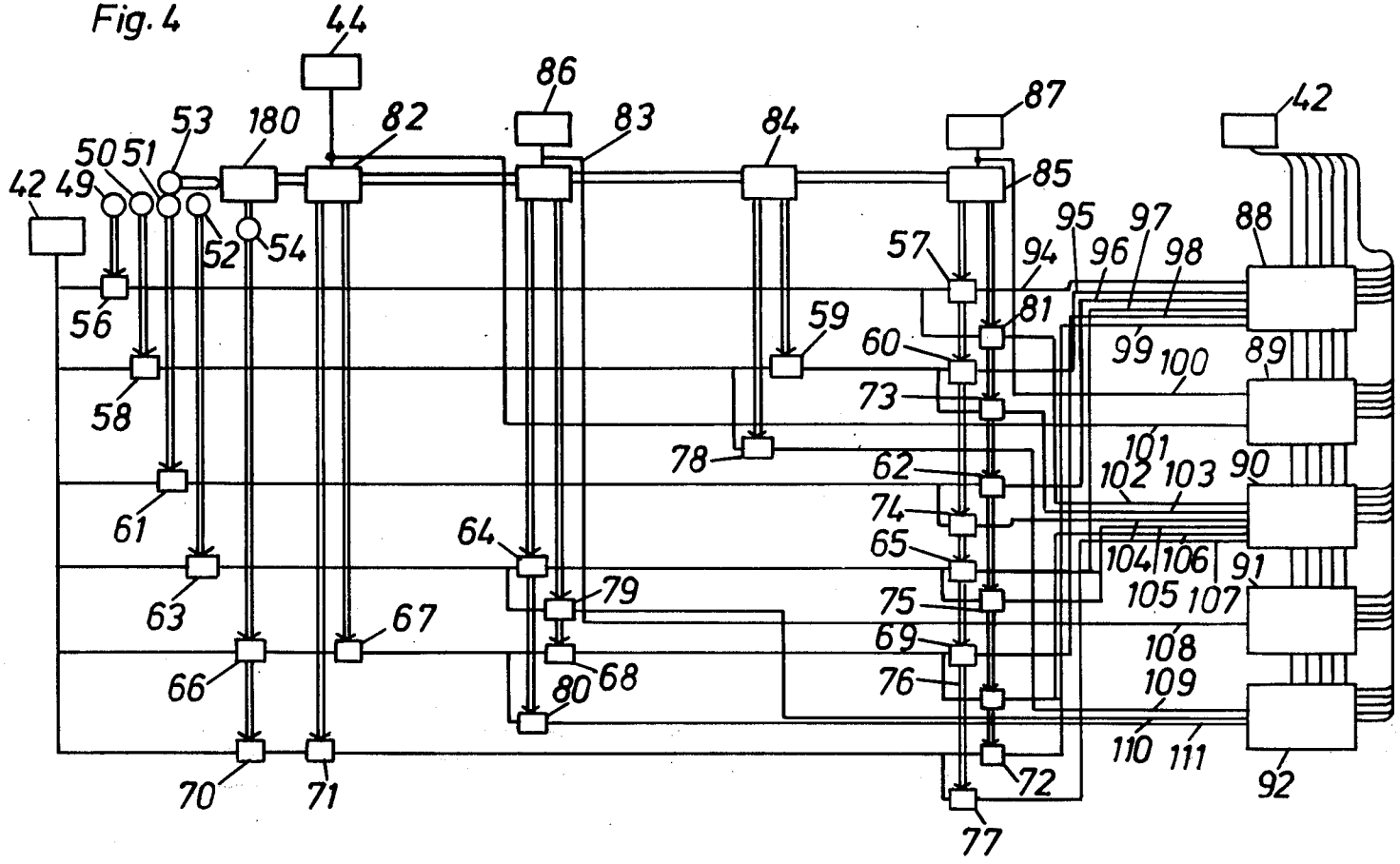
Figure 5:
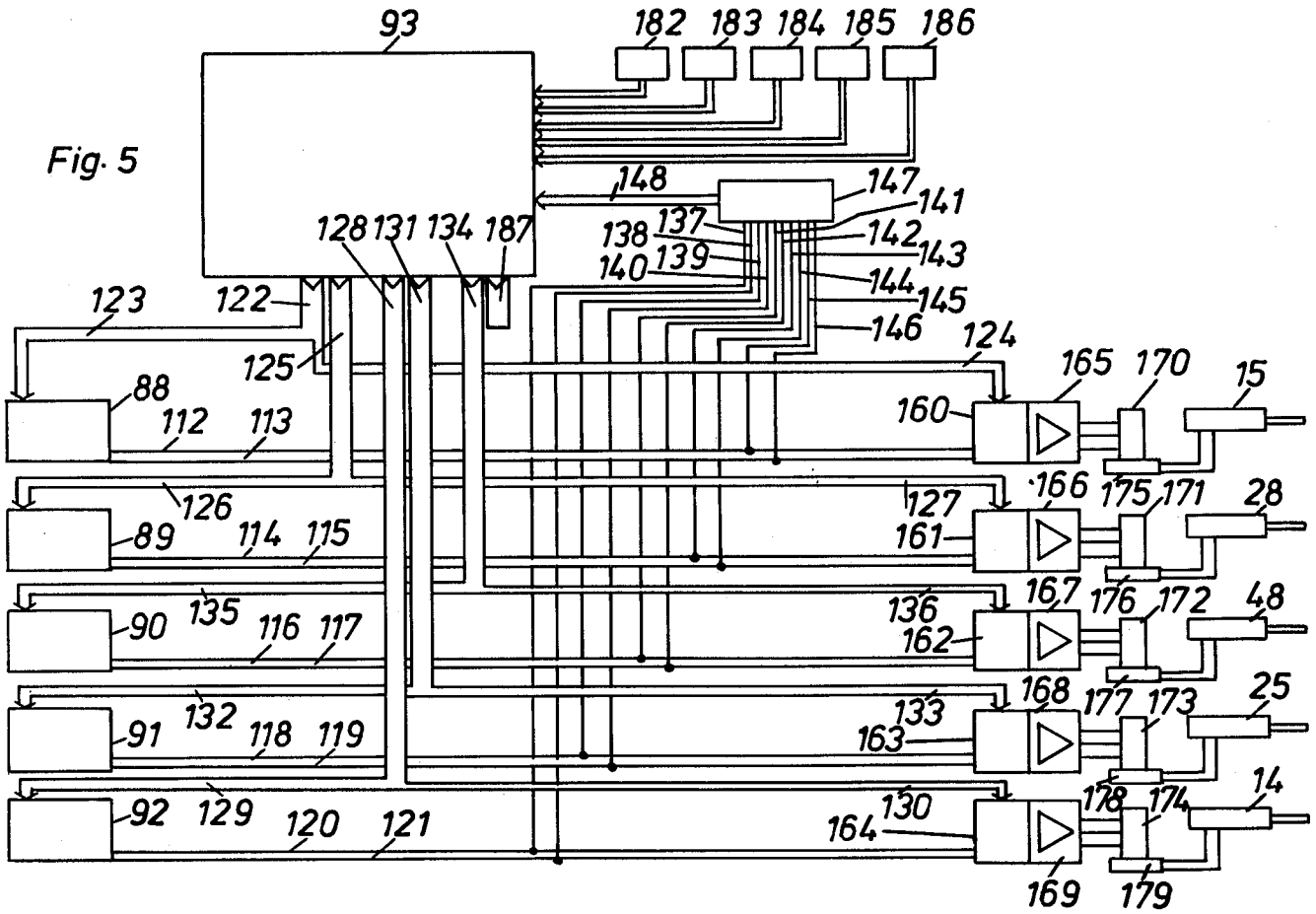

In FIGS. 3, 4 and 5, a block diagram illustrates how the positioning of the drill boom shown in FIGS. 1, 2 is carried out. Synchros 29, 30, 31, 32 and 33 are in known manner provided with two unmovable windings, which are perpendicular to one another and one turnable winding. The turning of the turnable winding corresponds to the turning of the shaft connected thereto. The unmovable windings are energized with two sine-wave, 90° dephased, voltages, which are generated in oscillators 34, 35 and transmitted via leads 38, 39, 40 and power amplifiers 36, 37. When turning the shaft of a synchro, a sine-wave voltage having a constant amplitude is generated over the turnable winding. This sine-wave voltage is dephased with respect to the voltages generated in the oscillators 34, 35 such that the phase displacement is proportional to the turning angle. The oscillators 34, 35 are controlled in respect to frequency and phase angle from a generator 42 via a frequency divider 41.

The output signals from the synchros are transmitted to signal converters 43, 44, 45, 46, 47 in which the signals are converted to pulse duration signals having the same frequency as the sine-wave signal but a pulse duration, which is proportional to the respective angle. A high frequency is superposed the pulse duration signals so that a high-frequent pulse train is obtained having a number of pulses which is proportional to respective angle. These pulse trains appear in a frequency which corresponds to the sine-wave voltage originally transmitted to the synchros. In a preferred embodiment, all synchros are fed with 400 Hz. The high frequency transmitted to the converters, has a frequency of about $400.\ 2.\pi.2^{11}$, i.e. about 5.1 MHz, which frequency is doubled in the converters. This means that $2\pi\ .\ 2^{12}$ pulses correspond to the turning angle of one revolution, i.e. $2^{12} = 4096$ pulses per radian. As regards the synchro 29 and the converter 43, the high frequency is given a value such that $\alpha_Z$ gets the same scale constant as the other lengths, L4, L5, L7, L8 and L9. Said frequency value is obtained by means of a binary-rate-multiplier which transforms a frequency from the generator 42 to a frequency which is suitable for the scale factor.

L10 is obtained in binary form on the output of a counter 180 as the sum of L9 and the feed displacement corresponding to $\alpha_Z$. Signals of this type, i.e. signals where the number of pulses in a given time interval convey information of a particular measure, are here called rate-signals. The pulses can be spaced equally or unequally within the interval or a part thereof. The time interval must be so long that the pulses within two consecutive intervals will be refound in the same order and number when the information is unchanged. If the pulses are spaced equally within the whole interval they can be spoken of as a pulse frequency.

Separate leads from the converters 43, 44, 45, 46, 47 are given signals indicating whether the angles are positive or negative with respect to the reference direction.

Units 86 and 87 form the angular sums required in the positioning equations, viz. $\alpha_x + \alpha_o$ and $\alpha_y + \alpha_s$.

$\alpha_o$, which is the angle of the boom bracket 12 relative to the Z-axis in the XZ-plane, is measured when the drill rig has taken up its position and is then set on a thumb wheel switch 181. The angular sum unit 87 comprises a special converter for converting the angle from the thumb wheel switch 181 from degrees to radians. The angular sum from the two units 86 and 87 is obtained as a pulse-rate-signal having 4096 pulses per radian in analogous manner as the signal from the converters 43, 44, 45, 46, 47.

In the above terms of the coordinates, sinus and cosinus of different angles are included. In order to get these values, the signals which represent the respective angles are transmitted to sin-cos-converters 82, 83, 84, 85. These converters give on its two outputs sinus and cosinus respectively of the angles and the angular sums in binary form and with 12 bit accuracy. Sinus 90°, thus, is represented by $2^{12}$.

In order to get signals representing the lengths L4, L5, L7, L8, L10, and signals representing sinus and cosinus of the angles $\alpha_o$, $\alpha_x$, $\alpha_y$, $\alpha_k$, $\alpha_s$, which signals can be added and multiplied, there are binary-rate-multipliers 55–81 in the control diagram.

The binary-rate-multipliers are designed such that if a rate signal is fed to the one input and a binary number to the other input there is obtained another rate-signal on its output representing the product of the two input measures.

There is the following relation:

$$r_{out} = (r_{in} \times B_{in}/4096)$$

where $r_{out}$ = output rate-signal
$r_{in}$ = input rate-signal
$B_{in}$ = input binary number $4096 = 2^{12}$ = maximum allowed input binary number Consequently, $r_{out}$ is always less than $r_{in}$.

The values of respectively L4, L5, L7, L8 and L9 corresponding to the dimensions of the drill rig are represented as binary numbers and are illustrated by 49, 50, 51, 52 and 53, respectively.

Units 88, 89, 90, 91, 92 for handling signals have inputs for rate-signals with sign transmitted from the binary-rate-multiplicators (the sign-leads are not shown), inputs for signals 123, 126, 135, 132, 129 representing set values of the measures X, Y, Z, K and S and inputs for administering the function of the unit. The rate-signals represent the instantaneous value of the coordinates X, Y, Z and the angles K and S. The rate-signals fed to one of these units are added with their signs and are compared with a signal from a data processing computer 93, the latter signal being transformed to a rate-signal and representing the set value. The difference is transformed to a pulse duration signal having a sign signal for X, Y, Z, S, K, respectively, which pulse duration signal is fed to leads 112–121.

In pulse-analogue- converters 160, 161, 162, 163, 164, these pulse duration signals are converted to an analogue voltage. The proportionality factor can be set by means of a binary signal from leads 124, 127, 136, 133, 130. Stabilizing nets being built-in optimize the dynamic characteristics of the different channels.

The signals treated in the above manner are then transmitted to control magnet amplifiers 165, 166, 167, 168, 169, wherein they are amplified and adapted to control magnets 170, 171, 172, 173, 174.

The control magnets actuate mechanically control valves 175, 176, 177, 178, 179, which give an oil flow being proportional to the input signal to the control magnet amplifiers. The speed of the hydraulic cylinders 15, 28, 48, 25, 14, thus, becomes proportional to the input signal to the control magnet amplifiers 165, 166, 167, 168, 169.

In the following, a positioning of a drill bit to a predetermined position is described. In the computer 93 are stored coordinates of the positions, where the drill bit is to be moved, and the desired drilling direction in these positions. The programmed positions are in an imaginary plane, which lies in front of the rock surface. The set value of the X-coordinate of the first position is transmitted to the counter unit 88 from the output 122 of the computer 93 via the lead 123. The product of L4 and sin $(\alpha_x + \alpha_o)$, the respective values taken from the multipliers 56 and 57 respectively, is transmitted via the lead 94 to the unit 88. Values of respectively L5, cos $\alpha_y$ and sin $(\alpha_x + \alpha_o)$ are obtained from the multipliers 58, 59 and 60 respectively. The product of these values is transmitted to the unit 88 via the lead 95. Values of L7 and cos $(\alpha_x \times \alpha_o)$ are obtained from the multipliers 61 and 62. The product of these values is transmitted to the unit 88 via the lead 96. The values of L8, sin $(\alpha_y + \alpha_s)$ and sin $(\alpha_x + \alpha_o)$ are from the multipliers 63, 64 and 65. The product of these values is transmitted to the unit 88 via the lead 97. The values of L10, cos $\alpha_k$, cos $(\alpha_y + \alpha_s)$ and sin $(\alpha_x + \alpha_o)$ are obtained from the multipliers 66, 67, 68 and 69. The product of these values is transmitted to the unit 88 via the lead 98. The values of L10, sin $\alpha_k$ and cos $(\alpha_x + \alpha_o)$ are obtained from the multipliers 70, 71 and 72. The product of these values is transmitted to the unit 88 via the lead 99. The values fed into the unit 88 via the leads 94–99 are summed and the sum is the instantaneous actual X-coordinate value of the drill bit.

This actual value is compared with the set value from the lead 123. Any differences between the actual value and the set value cause correction signals to be fed to pulse-analogue-converter 160 via leads 112, 113. The lead 112 indicates the duration of the correction signal while the lead 113 indicates the sign of the correction signal, i.e. in which direction the hydraulic cylinder in question, in this case the swing cylinder 15, has to be activated. The signal from the pulse-analogue-converter 160 is amplified in the amplifier 165, whereupon the signal actuates the control magnet 170. The control magnet adjusts a valve 175. Due to in which direction the valve 175 is adjusted hydraulic fluid is supplied to either of the two chambers of the hydraulic cylinder 15. The drill boom 10 is then swung.

The set value of the Y-coordinate of the first position is transmitted to the counter unit 92 from the output 128 of the computer 93 via the lead 129. The product of the values of respectively L5 and sin $\alpha_y$ obtained from the multipliers 58 and 78 respectively is transmitted to the unit 92 via the lead 109. The values of L8 and cos $(\alpha_y + \alpha_s)$ are obtained from the multipliers 63 and 79. The product of these values is transmitted to the unit 92 via the lead 110. The values of L10, cos $\alpha_k$ and sin $(\alpha_y + \alpha_s)$ are obtained from respectively the multipliers 66, 67 and 80. The product of these values is transmitted to the unit 92 via the lead 111. The values fed into the unit 92 via the leads 109–111 are summed and the sum represents the instantaneous actual Y-coordinate value of the drill bit. This actual value is compared with the set value fed via the lead 129. Any differences between the actual value and the set value cause a correction signal, which is fed to the pulse-analogue- converter 164 via leads 120 and 121 respectively for respectively the duration and the sign of the signal. The signal is amplified in the amplifier 169 and is transmitted to the magnet 174. The magnet adjusts the valve 179, which controls the elevating cylinder 14. The drill boom 10 is then elevated or lowered.

The set value of the Z-coordinate of the first position is transmitted to the counter unit 90 from the output 134 of the computer 93 via the lead 135. The product of the values of L4 and cos $(\alpha_x + \alpha_o)$ from the multipliers 56 and 81 respectively is fed to the unit 90 via the lead 102. The values of L5 cos $\alpha_y$ and cos $(\alpha_x + \alpha_o)$ are obtained from the multipliers 58, 59 and 73. The product of these values is transmitted to the unit 90 via the lead 103. The values of L7 and sin $(\alpha_x + \alpha_o)$ are obtained from the multipliers 61 and 74. The product of these values is transmitted to the unit 90 via the lead 104. The values of L8, sin $(\alpha_y + \alpha_s)$ and cos $(\alpha_x + \alpha_o)$ are obtained from the multipliers 63, 64 and 75. The product of these values is transmitted to the unit 90 via the lead 105. The values of L10, cos $\alpha_k$, cos $(\alpha_y + \alpha_s)$ and cos $(\alpha_x + \alpha_o)$ are obtained from the multipliers 66, 67, 68 and 76. The product of these values is transmitted to the unit 90 via the lead 106. The values of L10, sin $\alpha_k$ and sin $(\alpha_x + \alpha_o)$ are obtained from the multipliers 70, 71 and 77. The product of these values is transmitted to the unit 90 via the lead 107. The values fed into the unit 90 via the leads 102 – 107 are summed and the sum is the instantaneous actual value of the Z-coordinate of the drill bit. This actual value is compared with the set value fed via the lead 135. Any differences between the actual value and the set value cause a correction signal, which is transmitted to the pulse-analogue-converter 162 via leads 116 and 117 respectively for respectively the duration and the sign of the signal. The signal is amplified in the amplifier 167 and is then fed to the magnet 172. The magnet adjusts the valve 177, which controls the feed displacing cylinder 48. The feed bar 20 is then displaced.

The set value of the angle K of the first drill hole is transmitted to the counter unit 89 from the output 125 of the computer 93 via the lead 126. The sum of $\alpha_x$, and $\alpha_o$ is transmitted to the unit 93 via the lead 100. $\alpha_k$ is fed into the unit 93 via the lead 101. $\alpha_x$ and $\alpha_o$ and $\alpha_k$ are summed in the unit 89 and the sum is the instantaneous actual value of the angle K. This actual value is compared with the set value transmitted via the lead 126. Any differences between the actual value and the set value cause a correction signal, which is transmitted to the pulse-analogue-converter 161 via leads 114 and 115 for the duration and sign of the signal. The signal is amplified in the amplifier 166, whereupon it is transmitted to the magnet 171. The magnet adjusts the valve 176, which controls the swing cylinder 28. The feed bar 20 is then swung.

The set value of the angle S of the first drill hole is transmitted to the counter unit 91 from the output 131 of the computer 93 via the lead 132. $(\alpha_y + \alpha_s)$ is fed into the unit 91 via the lead 108. This value is the instantaneous actual value of the angle S. This actual value is compared with the set value transmitted via the lead 132. Any differences between the actual value and the set value cause a correction signal, which is fed to the pulse-analogue-converter 163 via the leads 118 and 119 for respectively the duration and the sign of the signal. The signal is amplified in the amplifier 168, and is then led to the magnet 173. The magnet adjusts the valve 178, which controls the tilt cylinder 25. The feed bar 20 is then tilted.

Between each of the leads 112–121 respectively a summation unit 147 is connected to a lead respectively 137–146. A lead 148 is connected between the summation unit 147 and the computer 93. The function of the summation unit 147 is to give order to the computer 93 when values of the next programmed point have to be taken out. Before this order is given, the values of X, Y, Z, K and S of the previous points have to be reached for a prescribed time. The condition for obtaining a signal from the summation unit 147 through the lead 148 is that all leads 137–146 have been without signal for a prescribed time. When the summation unit 147 has settled that the positioning is finished, the computer 93 gives order to lock the positioning, open the supply of flushing fluid, make a collaring and start the feed motor and rock drilling machine. The drill depth is measured by counting the number of pulses from a toothed wheel on the feed screw. A separate logical system, not shown in the block diagram, compares the actual drill depth with a drill depth programmed into the computer 93 via a lead 187. When similarity between measured and programmed drill depth is achieved, the drilling is stopped by reversing the feed motor.

Due to the irregularities of the rock surface, the Z-coordinates of the predetermined positions are defined such that they are in an imaginary plane, which is spaced from the rock surface, whereby safeguarding that the drill bit does not get stuck during movement from one position to another. When the summation unit 147 has stated that the positioning in the imaginry plane is finished, the computer 93 gives order to lock the drill boom and the feed bar against a turning about their axes, after a prescribed time delay displace the feed bar to rest against the rock, open the supply of flushing fluid, make a collaring and start the feed motor and the rock drilling machine. The displacement of the feed bar as well as the collaring can of course alternatively be carried out manually.

The desired values of the coordinates X, Y, and Z and the angles K, S and $\alpha$ are programmed starting from a given system of coordintes. Due to the face of country etc, it is not always possible to place the drill rig correctly in this system. In occurring cases, the given system of coordinates has to be transformed to one which coincides with the position in question of the drill rig. For this transformation there are correction units 181–186. The correction factors for respectively X, Y, Z, K and $\alpha$ are set by means of the respective unit or changer 181–186. The correction factors $X_o$, $Y_o$, $Z_o$, $K_o$, $S_o$ and $\alpha_o$ are defined by directly measuring the position and inclination of the swing shaft 16 and the boom bracket 12 with respect to the geodetically determined line of the tunnel extension.

What I claim is:

1. In a method of automatically positioning an elongated rock drilling apparatus to a plurality of predetermined positions in space, comprising swinging a drill boom (10) relative to a boom bracket (12), swinging a feed bar (20) relative to said drill boom and displacing said feed bar (20) relative to said drill boom and boom bracket, said boom and feed bar being swung to reach alternate positions, moving a rock drilling machine (21) longitudinally slidably to and fro along said feed bar, said rock drilling machine driving a working implement, and defining said plurality of predetermined positions by a programmed drilling pattern, the improvement comprising:

non-mechanically programming said plurality of predetermined positions such that they are in an imaginary plane (187) which is spaced from a rock surface (188) to be worked by entering set values corresponding to either of said predetermined directions and positions in a computer unit (93), sensing the actual values corresponding to either of the instantaneous direction and position of said drill bit, calculating the differences between said actual values and said set values, transforming said differences for providing control signals, and positioning said drill bit responsive to said control signals by means (15) for positioning said drill bit.

2. A method according to claim 1, comprising displacing said feed bar to abutment against the rock surface (188) after a given time delay upon a positioning of the rock drilling apparatus to a desired position in said imaginary plane (187).

3. A method according to claim 2, wherein said working implement is a drill bit, and comprising defining said predetermined positions by given values of coordinates in a system of coordinates, sensing the actual values of the coordinates of the drill bit in said system and moving said drill bit such that said sensed actual values are adjusted simultaneously toward said given values.

4. A method according to claim 3, wherein said working implement is a drill bit, and comprising positioning said elongated apparatus and said drill bit to a predetermined direction at said predetermined positions.

5. A method according to claim 2, wherein said working implement is a drill bit, and comprising positioning said elongated apparatus and said drill bit to a predetermined direction at said predetermined positions.

6. A method according to claim 1 wherein said working implement is a drill bit, and comprising defining said predetermined positions by given values of coordinates in a system of coordinates, sensing the actual values of the coordinates of the drill bit in said system and moving said drill bit such that said sensed actual values are adjusted simultaneously toward said given values.

7. A method according to claim 6, wherein said working implement is a drill bit, and comprising positioning said elongated apparatus and said drill bit to a predetermined direction at said predetermined positions.

8. A method according to claim 1, wherein said working implement is a drill bit, and comprising positioning said elongated apparatus and said drill bit to a predetermined direction at said predetermined positions.

9. A method according to claim 8, comprising defining said predetermined direction by given swing angles of said feed bar and said drill boom and swinging and displacing said feed bar simultaneously while swinging said drill boom.

10. A method according to claim 9, comprising simultaneously rotating and swinging said drill boom.

11. A method according to claim 1, comprising regulating the swinging velocities of respectively said feed bar and said drill boom relative to one another and relative to the displacing of said feed bar such that the swinging of said drill boom causes a movement of said drill bit which is faster than the resultant movement caused by the swinging and displacing of said feed bar.

12. In a method of automatically positioning an elongated rock drilling apparatus to a plurality of predetermined positions in space, comprising swinging a drill boom (10) relative to a boom bracket (12), swinging a feed bar (20) relative to said drill boom and displacing said feed bar (20) relative to said drill boom and boom bracket, said boom and feed bar being swung to reach alternate positions, moving a rock drilling machine (21) longitudinally slidably to and fro along said feed bar, said rock drilling machine driving a working implement, defining said plurality of predetermined positions by given values of coordinates in a system of coordinates, entering said given values in a computer unit, and sensing actual values of the coordinates of a drill bit in said system, calculating the difference between said actual values and said given values, transforming said differences and providing control signals corresponding thereto, and then moving said drill bit by swinging said drill boom, swinging said feed bar and displacing said feed bar longitudinally all at the same time, such that said sensed actual values are adjusted simultaneously toward said given values.

13. A method according to claim 12, wherein said elongated apparatus and said drill are positioned to a predetermined direction at said predetermined position, and comprising defining said predetermined direction by given swing angles of said feed bar and said drill boom and swinging and displacing said feed bar simultaneously while swinging said drill boom.

14. A method according to claim 13, comprising simultaneously rotating and swinging said drill boom.

15. An arrangement for automatically positioning an elongated rock drilling apparatus to a plurality of predetermined positions in space according to a programmed drilling pattern, comprising a support (12), a drill boom (10) swingably mounted on said support, an elongated rock drilling apparatus (20, 21) carried by said drill boom at the distal end thereof, and means for automatically moving said rock drilling apparatus from a first predetermined position to a second predetermined position in an imaginary plane (187) which is spaced from a rock surface (188) to be worked upon completion of a drill hole corresponding to said first predetermined position in said imaginary plane, said moving means including:

means (33) for sensing the actual value of the coordinates of said rock drilling apparatus in a system of coordinates, a computer unit (93) for non-mechanically registering set values corresponding to said predetermined positions, means (88) for non-mechanically registering actual values corresponding to the instantaneous value of the coordinates of said rock drilling apparatus, means (88) for non-mechanically calculating differences between said actual values and set values, means (160, 165) coupled to said calculating means for non-mechanically transforming said differences to control signals, and means (170, 175, 15) controlled by said control signals for automatically moving said rock drilling apparatus.

16. An arrangement according to claim 15, wherein said elongated rock drilling apparatus is automatically positioned to predetermined directions in said predetermined positions, said sensing means (33) senses the actual value of the angle or angles of said rock drilling apparatus, said computer unit (93) registers set values corresponding to said predetermined directions, said registering means (88) registers actual values corresponding to the instantaneous value of the angle or angles of said rock drilling apparatus, said calculating means (88) calculates differences between said actual values and set values of said angle or angles, and said transforming means (160, 165) transforms said angle differences to angle control signals, and said moving means (170, 175, 15) is controlled by said angle control signals for moving said rock drilling apparatus in such a way that the sensed angle values are adjusted simultaneously toward given values corresponding to said predetermined directions.

17. An arrangement according to claim 16, wherein said rock drilling apparatus includes a feed bar (20) and a rock drilling machine (21) mechanically fed to and fro therealong, comprising hydraulic cylinder means for swinging said drill boom relative to a boom bracket (12), swinging said feed bar relative to said drill boom and displacing said feed bar relative to said boom bracket, and control means (170–179) associated with said hydraulic cylinders for swinging and displacing said feed bar and swinging said drill boom simultaneously.

18. An arrangement for positioning a working implement (24) to either of a predetermined direction and position, comprising a support (12), an arm (10) swingably mounted on said support and carrying said working implement, means (33) for sensing the actual value of either of the angle or angles and the coordinates of said working implement in a system of coordinates, a computer unit (93) for registering set values corresponding to said predetermined direction and position, means (88) for registering actual values corresponding to the instantaneous value of either of the angle or angles and coordinates of said working implement, means (88) for calculating differences between said actual values and set values, means (160–165) for transforming said differences to control signals, and means (170, 175, 15) controlled by said control signals for moving said working implement by swinging said drill boom, swinging said feed bar and displacing said feed bar longitudinally all at the same time, such that the sensed values are adjusted simultaneously toward given values corresponding to said predetermined direction and position.

19. An arrangement according to claim 18, wherein the working implement is a drill bit (24), the swingable arm comprises a drill boom (10) and a feed bar (20) which carries a rock drilling machine (21), and wherein the drill boom (10) is swingable relative to a boom bracket (12) and the feed bar (20) is swingable relative to the drill boom (10) and displaceable relative to the boom bracket (12) by means of hydraulic cylinders (15, 26; 25, 28, 48), comprising control means (170–179) associated with said hydraulic cylinders for swinging and displacing the feed bar and swinging the drill boom simultaneously.

20. An arrangement according to claim 15, wherein said means controlled by said control signals automatically moves said rock drilling apparatus such that the sensed values are adjusted simultaneously toward given values corresponding to said predetermined positions by swinging said drill boom, swinging said feed bar and displacing said feed bar longitudinally all at the same time.

* * * * *